US005208862A

United States Patent [19]

Ozawa

[11] Patent Number: 5,208,862

[45] Date of Patent: May 4, 1993

[54] SPEECH CODER

[75] Inventor: Kazunori Ozawa, Tokyo, Japan

[73] Assignee: NEC Corporation, Tokyo, Japan

[21] Appl. No.: 658,473

[22] Filed: Feb. 20, 1991

[30] Foreign Application Priority Data

Feb. 22, 1990 [JP] Japan ..... 2-42955
Feb. 22, 1990 [JP] Japan ..... 2-42956

[51] Int. Cl.[5] ..... G10L 5/00

[52] U.S. Cl. ..... 381/36; 381/40

[58] Field of Search ..... 381/40, 39, 38, 36, 381/29; 395/2

[56] References Cited

U.S. PATENT DOCUMENTS 4,852,179 7/1989 Fette ..... 381/29
4,980,916 12/1990 Zinser ..... 381/31 X
5,023,910 6/1991 Thomson ..... 381/37

FOREIGN PATENT DOCUMENTS 0342687 11/1989 European Pat. Off. .
2199215 6/1988 United Kingdom .

OTHER PUBLICATIONS

Manfred R. Schroeder et al. "Code-Excited Linear Prediction (CELP): High-Quality Speech at Very Low Bit Rates" 1985 IEEE, pp. 937-940.

"Multi-Level Clustering of Acoustic Features for Phoneme Recognition Based on Mutual Information" by Shirai et al. CH2673-2/89/0000-0604 IEEE Feb. 1989.

ICASSP1990-1990 International Conference on Acoustics, Speech and Signal Processing, Albuquerque, New Mexico, Apr. 3-6, 1990, vol. 1, pp. 485-488, *IEEE*, New York, P. Dymarksi et al., "Optimal and sub-optimal algorithms for selecting the excitation in linear predictive coders".

Speech Communication, vol. 7, No. 3, Oct. 1988, pp. 305-316, Elsevier Science Publishers B.V. (North-Holland), Amsterdam, NL; W. B. Kleijn et al. "An efficient stochastically excited linear predictive coding algorithm for high quality low bit rate transmission of speech".

ICASSP1989-1989 International Conference on Acoustics, Speech and Signal Processing, Glasgow, May 23-26, 1989, vol. 1, pp. 132-135, IEEE, NY, US; J. Menez et al: "Adaptive code excited linear predictive coder (ACELPC)".

ICASSP-1988 International Conference on Acoustics, Speech and Signal Processing, NY, Apr. 11-14, 1988, vol. 1, pp. 163-166, IEEE, NY, US; G. Davidson et al. "Multiple-stage vector excitation coding of speech waveforms".

Signal Processing IV: Theories and Applications--Proceedings of EUSIPCO-88, Fourth European Signal Processing Conference, Grenoble, Sep. 5-8, 1988, vol. 2, pp. 859-862, North-Holland Publishing Co., Amsterdam, NL; D. Lin: "Vector excitation coding using a composite source model."

ICASSP1990-1990 International Conference on Acoustics, Speech and Signal Processing, Albuquerque, New Mexico, Apr. 3-6, 1990, vol. 1, pp. 461-464, IEEE, New York, US; I. A. Gerson et al.: "Vector sum excited linear prediction 9VSELP) speech coding at 8 KBS".

*Primary Examiner*—Emanuel S. Kemeny
*Attorney, Agent, or Firm*—Sughrue, Mion, Zinn, Macpeak & Seas

[57] ABSTRACT

A speech coder includes an LPC analyzer, a difference signal generating section, a first code book, a second code book, and a multiplexer. The LPC analyzer divides an input discrete speech signal into signal components in units of frames each having a predetermined time length, and obtains a spectrum parameter representing a spectrum envelope of the speech signal. The difference signal generating section obtains a difference signal by dividing the frame into subframes each having a predetermined time length, and predicting a pitch parameter representing a long-term correlation on the basis of a past sound source signal The first code book stores a signal formed beforehand by off line training learning based on the difference signal. The second code book stores a signal having predetermined characteristics or a signal formed beforehand by learning. The multiplexer represents a sound source signal of the speech signal by a linear combination of a signal selected from the first code book in accordance with each obtained difference signal and a signal selected from the second code book, and outputs the combination.

9 Claims, 7 Drawing Sheets

SPEECH CODER

BACKGROUND OF THE INVENTION

The present invention relates to a speech coder for coding a speech signal with high quality at low bit rates, specifically, at about 8 to 4.8 kb/s.

As a method of coding a speech signal at a low bit rate of about 8 to 4.8 kb/s, CELP (Code Excited LPC Coding) is known, which is disclosed in, e.g., M. Schroeder and B. Atal, "Code-excited linear prediction: High Quality speech at very low bit rates", ICASSP, pp. 937–940, 1985 (reference 1). According to this method, on the transmission side, a spectrum parameter representing the spectrum characteristics of a speech signal is extracted from a speech signal of each frame (e.g., 20 ms). A frame is divided into subframes (e.g., 5 ms), and a pitch parameter representing a long-term correlation (pitch correlation) is extracted from a past sound source signal in units of subframes. Long-term prediction of speech signals in the subframes is performed using the pitch parameter to obtain difference signals. For the difference signal obtained by long-term prediction, one type of noise signal is selected so as to minimize the differential power between the speech signal and a signal synthesized by a signal selected from a code book constituted by predetermined types of noise signals. In addition, an optimal gain is calculated. Subsequently, an index representing the type of selected noise signal and the gain are transmitted together with the spectrum parameter and the pitch parameter. A description on the receiver side will be omitted.

As a method of quantizing a spectrum parameter, a scalar quantization method is used in reference 1. A vector quantization method is known as a method which allows more efficient quantization with a smaller amount of bits than the scalar quantization method. With regard to this method, refer to, e.g., Buzo et al., "Speech Coding Based upon Vector Quantization", IEEE Trans ASSP, pp. 562–574, 1980 (reference 2). In vector quantization, however, a data base (training data) for a learning procedure is required to form a vector quantization code book in advance. The characteristics of a vector quantizer depend on training data used. For this reason, the performance of the quantizer deteriorates with respect to a signal having characteristics which are not covered by the training data, resulting in a deterioration in speech quality. In order to solve such a problem, a vector/scalar quantization method is proposed, in which an error signal representing the difference between a vector-quantized signal and an input signal is scalar-quantized to combine the merits of the two methods. With regard to vector/scalar quantization, refer to, e.g., Moriya et al., "Adaptive Transform Coding of Speech Using Vector Quantization", Journal of the Institute of Electronics and Communication Engineers of Japan, vol. J. 67-A, pp. 974–981, 1984 (reference 3). A description of this method will be omitted.

In the conventional method disclosed in reference 1, in order to obtain high speech quality, the bit size of a code book constituted by noise signals must be set to be as large as 10 bits or more. Therefore, an enormous amount of operations are required to search the code book for an optimal noise signal (code word). In addition, since a code book is basically constituted by noise signals, speech reproduced by a code word selected from the code book inevitably includes perceptual noise.

Furthermore, in the conventional method in reference 1, since a spectrum parameter is quantized/coded by normal scalar quantization, a large number of bits are required for quantization. For this reason, it is difficult to decrease the bit rate while keeping high speech quality.

In the vector quantization method which is more efficient than the scalar quantization method, quantization characteristics depend on training data used for preparing a vector quantization code book. For this reason, the quantization performance deteriorates with respect to a signal having characteristics which are not covered by the training data, resulting in a deterioration in speech quality.

In the vector/scalar quantization method disclosed in reference 3, in addition to a code book table for vector quantization, another table is required to store information required for scalar quantization in accordance with the size of a code book for vector quantization. Assume that a 10th-order parameter and an 8-bit vector quantizer are used. The number of tables required for vector quantization is $256\times10=2{,}560$. The number of tables required for scalar quantization is $256\times10=2{,}560$. That is, a total of 5,120 tables are required, and hence a large memory capacity is required to store these tables.

SUMMARY OF THE INVENTION

It is a principal object of the present invention to provide a speech coder which requires only a small amount of operations.

It is another object of the present invention to provide a speech coder which requires only a small memory capacity.

It is still another object of the present invention to provide a speech coder which ensures high speech quality.

It is still another object of the present invention to provide a speech coder which can eliminate perceptual noise.

It is another object of the present invention to provide a speech coder which can decrease a bit rate In order to achieve the above objects, according to the present invention, there is provided a speech coder characterized by comprising means for dividing an input discrete speech signal into signal components in units of frames each having a predetermined time length, and obtaining a spectrum parameter representing a spectrum envelope of the speech signal, means for obtaining a difference signal by dividing the frame into subframes each having a predetermined time length, and calculating a pitch parameter representing a long-term correlation on the basis of a past sound source signal, a first code book for storing a signal formed beforehand by learning based on the difference signal, a second code book for storing a signal having predetermined characteristics, and means for representing a sound source signal of the speech signal by a linear combination of a signal selected from the first code book in accordance with each obtained difference signal and a signal selected from the second code book, and outputting the combination.

A function of the speech coder of the present invention will be described below.

According to the present invention, a sound source signal is obtained so as to minimize the following equation in units of subframes obtained by dividing a frame:

$$E = \sum_n [\{x(n) - \beta v(n - M)*h(n) - d(n)*h(n)\}*w(n)]^2 \quad (1)$$

where $\beta$ and M are the pitch parameters of pitch prediction (or an adaptive code book) based on long-term correlation, i.e., a gain and a delay, v(n) is the sound source signal in a past subframe, h(n) is the impulse response of a synthetic filter constituted by a spectrum parameter, and w(n) is the impulse response of a perceptual weighting filter Note that * represents a convolution operation. Refer to reference 1 for a detailed description of w(n).

In addition, d(n) represents a sound source signal represented by a code book and is given by a linear combination of a code word $c_{1j}(n)$ selected from a first code book and a code word $c_{2i}(n)$ selected from a second code book as follows:

$$d(n) = \sum_i \gamma_i c_i(n) = \gamma_1 c_{1j}(n) + \gamma_2 c_{2i}(n) \quad (2)$$

where $\gamma_1$ and $\gamma_2$ are the gains of the selected code words $c_{1j}(n)$ and $c_{2i}(n)$. In the present invention, since a sound source signal is represented by two types of code books, each code book is only required to have bits ½ the number of bits of the overall code book. For example, if the number of bits of the overall code book is 10 bits, each of the first and second code books is only required to have 5 bits This greatly reduces the operation amount required to search the code book.

Assume that the noise code book in reference 1 is used as each code book, and the code book is divided in the same manner as indicated by equation (2). It is known, in this case, that a sound source signal obtained by this method deteriorates as compared with a signal obtained by a 10-bit code book in terms of characteristics, and the performance of the overall code book corresponds to only 7 to 8 bits.

In the present invention, therefore, in order to obtain high performance, the first code book is prepared by a learning procedure using training data. As a method of preparing a code book by a learning procedure, a method disclosed in Linde et al., "An algorithm for Vector Quantization Design", IEEE Trans. COM-28, pp. 84–95, 1980 (reference 4) is known.

As a distance scale for a learning procedure, a square distance (Euclidean distance) is normally used. In the method of the present invention, however, a perceptual weighting distance scale represented by the following equation, which allows higher perceptual performance than the square distance, is used:

$$D = \sum_n [\{t_j(n) - c_1(n)*h(n)\}*w(n)]^2 \quad (3)$$

where $t_j(n)$ is the jth training data, and $c_1(n)$ is a code word in a cluster 1. A centroid $s_{c1}(n)$ (representative code) of the cluster 1 is obtained so as to minimize equation (4) or (5) below by using training data in the cluster 1.

$$E = \sum_i \sum_n [\{t_{i1}(n) - s_{c1}(n)*h(n)\}*w(n)]^2 \quad (4)$$

-continued $$E = \sum_i \sum_n [\{t_{i1}(n) - g \cdot s_{c1}(n)*h(n)\}*w(n)]^2 \quad (5)$$

In equation (5), q is an optimal gain.

As the second code book, a code book constituted by noise signals or random number signals whose statistical characteristics are determined in advance, such as Gaussian noise signals in reference 1, or a code book having different characteristics is used to compensate for the dependency of the first code book on training data. Note that a further improvement in characteristics can be ensured by selecting noise signal or random number code books on a certain distance scale. For a detailed description of this method, refer to T. Moriaya et al., "Transform Coding of speech using a Weighted Vector Quantizer", IEEE J. Sel. Areas, Commun., pp. 425–431, 1988 (reference 5).

Furthermore, in the present invention, the spectrum parameters obtained in units of frames are subjected to vector/scalar quantization. As spectrum parameters, various types of parameters, e.g., LPC, PARCOR, and LSP, are known. In the following case, LSP (Line Spectrum Pair) is used as an example. For a detailed description of LSP, refer to Sugamura et al., "Quantizer Design in LSP Speech Analysis-Synthesis", IEEE J. Sel. Areas, Commun., pp. 432–440, 1988 (reference 6). In vector/scalar quantization, an LSP coefficient is vector-quantized first A vector quantizer for LSP prepares a vector quantization code book by performing a learning procedure with respect to LSP training data using the method in reference 4. Subsequently, in vector quantization, a code word which minimizes the distortion of the following equation is selected from the code book:

$$D = \sum_{i=1}^{L} \{p(i) - q_j(i)\}^2 \quad (j = 1 \sim 2^B) \quad (6)$$

where p(i) is the ith LSP coefficient obtained by analyzing a speech signal in a frame, L is the LSP analysis order, $q_j(i)$ is the ith coefficient of the code word, and B is the number of bits of the code book. Although a square distance is used as a distance scale in the above equation, another proper distance scale may be used.

A vector-quantized difference signal is then obtained by using the selected code word $q_j(i)$ according to the following equation:

$$e(i) = p(i) - q_j(i) \quad (i = 1 \sim L) \quad (7)$$

The difference signal e(i) is scalar-quantized by scalar quantization In the design of a scalar quantizer, the statistic distribution of e(i) of a large amount of signals e(i) is measured for every order i so as to determine the maximum and minimum values of the quantization range of the quantizer for each order. For example, a 1% point and a 99% point of the statistic distribution of e(i) are measured so that the measurement values are set to be the maximum and minimum values of the quantizer. With this operation, in scalar quantization, if the order of LSP is represented by L, only L×2 tables are required. Since the order L is normally set to be about 10, only 20 tables are required.

In addition, according to the present invention, an improvement in characteristics is realized by searching the first and second code books while adjusting at least one gain, or optimizing the two gains upon determination of code words of the two code books.

Assume that the first and second code books are searched while their gains are adjusted. More specifically, code words of the first code book are determined, and the second code book is searched while the following equation is minimized for each code word:

$$E = \sum_n [\{x(n) - \gamma_1 c_{1i}(n)*h(n) - \gamma_2 c_{2i}(n)*h(n)\}*w(n)]^2 \quad (8)$$

where $\gamma_1$ and $\gamma_2$ are the gains of the first and second code books, and $c_{1i}(n)$ and $c_{2i}(n)$ are code words selected from the first and second code books. All the values of $c_{2i}(n)$ in equation (8) are calculated to obtain the code word $c_{2i}(n)$ which minimizes error power E and to obtain the gains $\gamma_1$ and $\gamma_2$ at the same time.

These calculations can be performed by using the Gram-Schmidt orthogonalization process.

The operation amount can be reduced in the following manner. Instead of calculating equation (8) in code word search, the optimal gains $\gamma_1$ and $\gamma_2$ are obtained by independently determining the code words of the first and second code books and solving equation (8) for only the determined code words $c_{1i}(n)$ and $c_{2i}(n)$.

In addition, according to the present invention, after optimal code words are selected from the first and second code books, the gains $\gamma_1$ and $\gamma_2$ of the first and second code books are efficiently vector-quantized by using a gain code book prepared by learning procedure. In vector quantization, when optimal code words are to be searched out, a code word which minimizes the following equation is selected:

$$E = \sum_n [\{x(n) - \beta v(n - M)*h(n) - \sum_i \gamma'_i c_i(n)*h(n)\}*w(n)]^2 \quad (9)$$

where $\gamma_1$ is the vector-quantized gain represented by each code word, and $c_i(n)$ is a code word selected from each of the first and second code books. If the following equation is established on the basis of equation (9):

$$e_w(n) = x(n)*w(n) - \beta v(n-M)*h(n)*w(n) \quad (10)$$

then, the following equation is obtained from equations (9) and (10):

$$E = \sum_n e_w(n)^2 - [2\gamma'_1 \Sigma e_w(n) s_{w1}(n) + 2\gamma'_2 \Sigma e_w(n) s_{w2}(n) - \gamma'^2_1 \Sigma s^2_{w1}(n) - \gamma'^2_2 \Sigma s^2_{w2}(n) - 2\gamma'_1\gamma'_2 \Sigma s_{w1}(n) s_{w2}(n)] \quad (11)$$

In this case, $$s_{w1}(n) = C_1(n)*h(n)*w(n) = C_1(n)*h_w(n) \quad (12)$$

$$s_{w2}(n) = c_2(n)*h(n)*w(n) = C_2(n)*h_w(n) \quad (13)$$

Since the first term of equation (11) is a constant, a code word which maximizes the second and subsequent terms is selected in code word search.

In addition, in order to greatly reduce the operation amount required for code book search, a code word may be selected according to the following equation:

$$E = \sum_i (\gamma_i - \gamma_{ij})^2 \quad (14)$$

where a code book for vector-quantizing a gain is prepared by a training procedure using training data constituted by a large amount of values. The learning procedure for a code book may be performed by the method in reference 4. In this case, a square distance is normally used as a distance scale in learning However, for a further improvement in characteristics, a distance scale represented by the following equation may be used:

$$E = \left\{ \sum_n \gamma_{ti} c_i(n)*h(n)*w(n) - \sum_n \gamma'_{i1} c_i(n)*w(n) \right\}^2 \quad (15)$$

where $\gamma_{ti}$ is gain data for a training procedure, and $\gamma'_{i1}$ is a representative code word in the cluster 1 of the gain code book: If the distance scale represented by equation (15) is used, a centroid $Sc_{1i}$ in the cluster 1 is obtained so as to minimize the following equation:

$$D_1 = \Sigma \left\{ \Sigma \gamma_{ti} c_i(n)*h(n)*w(n) - \sum_n^a Sc_{i1} c_{ci}(n)*h(n)*w(n) \right\}^2 \quad (16)$$

On the other hand, in order to greatly reduce the operation amount in learning, a distance scale represented by the following equation, which is based on a normal square distance, may be used:

$$D = \sum_i (\gamma_i - Sc_{ij})^2 \quad (17)$$

Moreover, the present invention is characterized in that the gain of a pitch parameter of pitch prediction (adaptive code book) is vector-quantized by using a code book formed beforehand by learning. If the order of pitch prediction is one, vector quantization of a gain is performed by selecting a code word which minimizes the following equation after determining a delay amount M of a pitch parameter:

$$E = \sum_n [\{x(n) - \beta'_j V(n - M)*h(n)\}*w(n)]^2 \quad (18)$$

A distance scale in a learning procedure for a code book is given by the following equation:

$$E = \sum_n [\{\beta_t V(n - M)*h(n) - \beta'_1 V(n - M)*h(n)\}*w(n)]^2 \quad (19)$$

$$= \sum_n [\{\beta_t - \beta'_1\} V(n - M)*h(n)*w(n)]^2 \quad (20)$$

where $\beta_t$ is gain data for code book training. Note that the operation amount can also be reduced by using the following equation:

$$E = \{\beta_t - \beta'_1\}^2 \quad (21)$$

DESCRIPTION OF THE PREFERRED EMBODIMENTS

Figure 1:
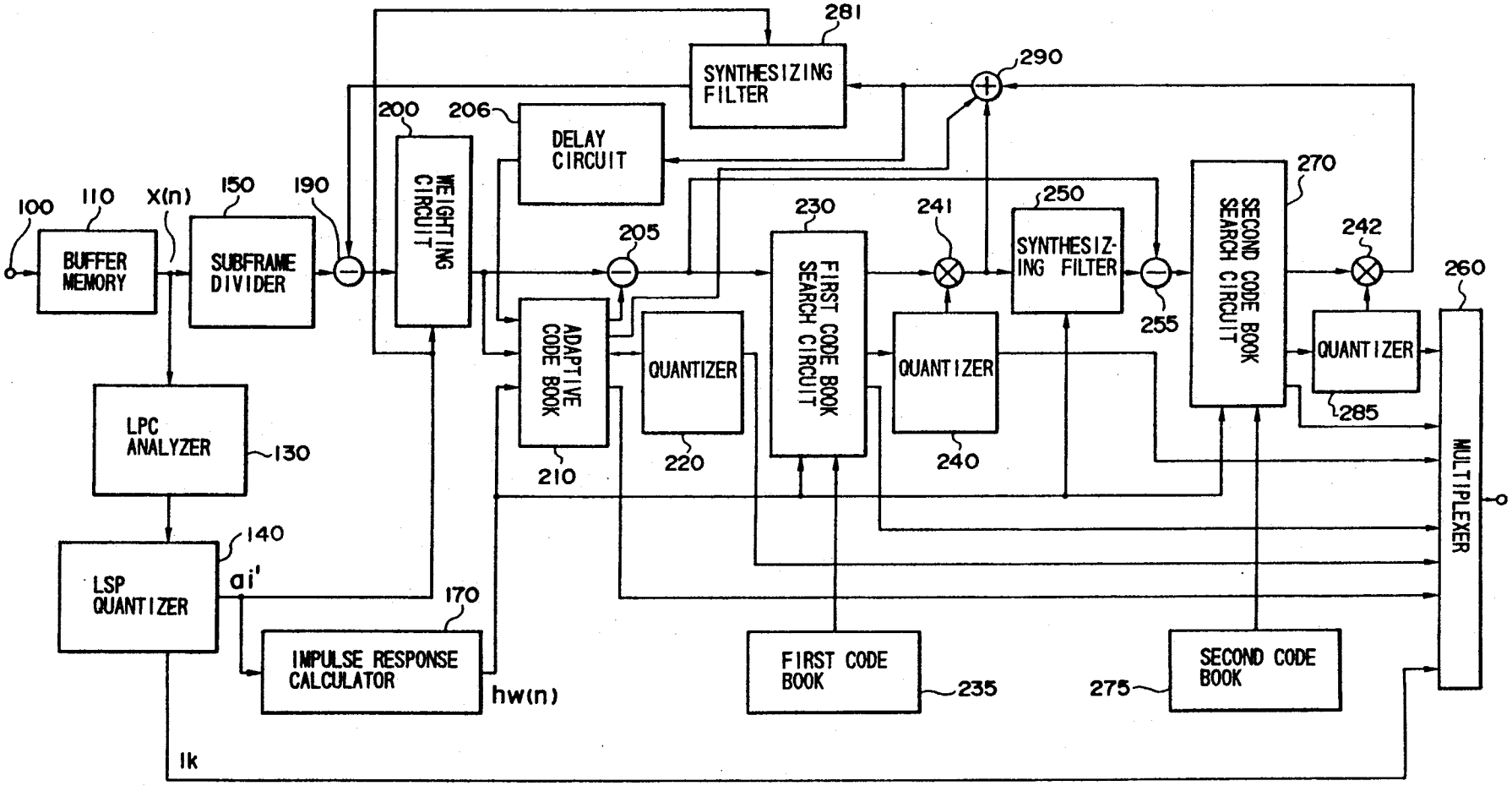
FIG. 1 is a block diagram showing a speech coder according to an embodiment of the present invention.

FIG. 1 shows a speech coder according to an embodiment of the present invention.

Referring to FIG. 1, on the transmission side, a speech signal is input from an input terminal 100, and a one-frame (e.g., 20 ms) speech signal is stored in a buffer memory 110.

An LPC analyzer 130 performs known LPC analysis of an LSP parameter as a parameter representing the spectrum characteristics of a speech signal in a frame on the basis of the speech signal in the above-mentioned frame so as to perform calculations by an amount corresponding to predetermined order L. For a detailed description of this method, refer to reference 6. Subsequently, an LSP quantizer 140 quantizes the LSP parameter with a predetermined number of quantization bits, and outputs an obtained code $1_k$ to a multiplexer 260. At the same time, the LSP quantizer 140 decodes this code to convert it into a linear prediction coefficient $a'_i$ ($i=1\sim L$) and outputs it to a weighting circuit 200, an impulse response calculator 170, and a synthetic filter 281. With regard to the methods of coding an LSP parameter and converting it into a linear prediction coefficient, refer to reference 6.

A subframe divider 150 divides a speech signal in a frame into signal components in units of subframes. Assume, in this case, that the frame length is 20 ms, and the subframe length is 5 ms.

A subtractor 190 subtracts an output, supplied from the synthetic filter 281, from a signal component obtained by dividing the input signal in units of subframes, and outputs the resultant value.

The weighting circuit 200 performs a known perceptual weighting operation with respect to the signal obtained by subtraction. For a detailed description of a perceptual weighting function, refer to reference 1.

An adaptive code book 210 receives an input signal v(n), which is input to the synthetic filter 281, through a delay circuit 206. In addition, the adaptive code book 210 receives a weighted impulse response $h_w(n)$ and a weighted signal from the impulse response calculator 170 and the weighting circuit 200, respectively, to perform pitch prediction based on long-term correlation, thus calculating a delay M and a gain $\beta$ as pitch parameters. In the following description, the prediction order of the adaptive code book is set to be 1. However, a second or higher prediction order may be set. A method of calculating the delay M and the gain $\beta$ in an adaptive code book of first order is disclosed in Kleijin et al., "Improved speech quality and efficient vector quantization in SELP", *ICASSP*, pp. 155–158, 1988 (reference 7), and hence a description thereof will be omitted. Furthermore, the obtained gain $\beta$ is quantized/decoded with a predetermined number of quantization bits to obtain a gain $\beta'$ by using a quantizer 220. A prediction signal $x_w(n)$ is then calculated by using the obtained gain $\beta'$ according to the following equation and is output to a subtractor 205, while the delay M is output to the multiplexer 260:

$$x_w(n)=\beta'\cdot v(n-M)*h_w(n) \tag{22}$$

where v(n−M) is the input signal to the synthetic filter 281, and $h_w(n)$ is the weighted impulse response obtained by the impulse response calculator 170.

The delay circuit 206 outputs the input signal v(n), which is input to the synthetic filter 281, to the adaptive code book 210 with a delay corresponding to one subframe.

The quantizer 220 quantizes the gain $\beta$ of the adaptive code book with a predetermined number of quantization bits, and outputs the quantized value to the multiplexer 260 and to the adaptive code book 210 as well.

The subtractor 205 subtracts the output $x_w(n)$, which is output from the adaptive code book 210, from an output signal from the weighting circuit 200 according to the following equation, and outputs a resulting difference signal $e_w(n)$ to a first code book search circuit 230:

$$e_w(n)=x_w(n)-x_w(n) \tag{23}$$

The impulse response calculator 170 calculates the perceptual-weighted impulse response $h_w(n)$ of the synthetic filter by an amount corresponding to a predetermined sample count Q. For a detailed description of this calculation method, refer to reference 1 and the like.

The first code book search circuit 230 searches for an optimal code word $c_{1j}(n)$ and an optimal gain $\gamma_1$ by using a first code book 235. As described earlier, the first code book is prepared by a learning procedure using training signals.

Figure 2:
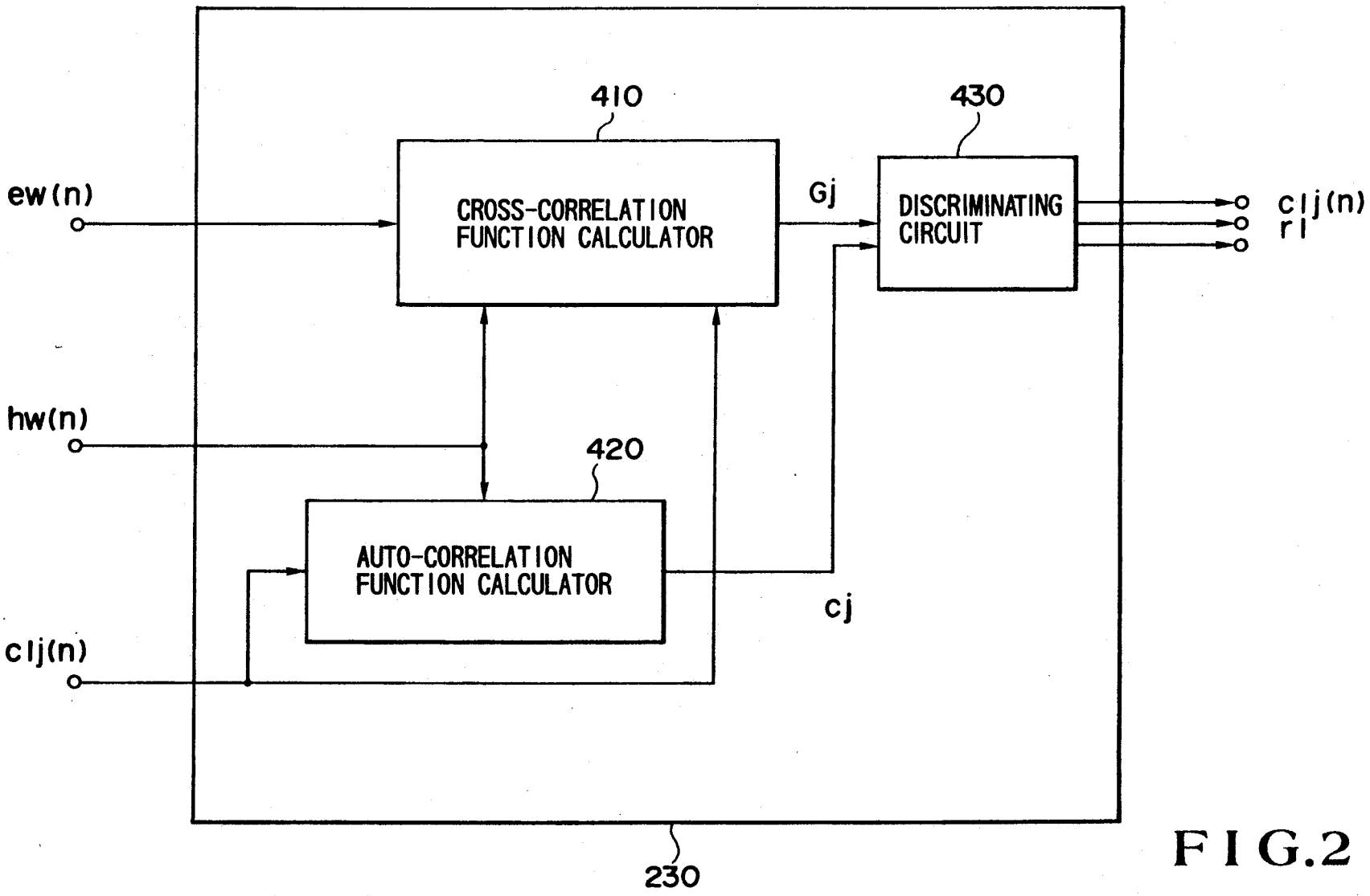
FIG. 2 is a block diagram showing an arrangement of a code book search circuit of the speech coder in FIG. 1.

FIG. 2 shows the first code book search circuit 230. A search for a code word is performed in accordance with the following equation:

$$E=\sum_n [e_w(n)-\gamma_1 c_{1j}(n)*h_w(n)]^2 \tag{24}$$

A value $\gamma_1$ which minimizes equation (24) is obtained by using the following equation obtained by partially differentiating equation (24) with $\gamma_1$ and substituting the zero therein:

$$\gamma_1=Gj/Cj \tag{25}$$

for $$Gj=\sum_n e_w(n)\{c_{1j}(n)*h_w(n)\} \tag{26}$$

$$Cj=\sum_n \{c_{1j}(n)*h_w(n)\}^2 \tag{27}$$

Therefore, equation (24) is rewritten as:

$$E = \sum_n e_w(n)^2 - G_j^2/C_j \tag{28}$$

In this case, since the first term of equation (28) is a constant, a code word $c_{1j}(n)$ is selected from the code book so as to maximize the second term.

Referring to FIG. 2, a cross-correlation function calculator 410 calculates equation (26), an auto-correlation function calculator 420 calculates equation (27), and a discriminating circuit 430 calculates equation (28) to select the code word $c_{1j}(n)$ and output an index representing it. The discriminating circuit 430 also outputs the gain $\gamma_1$ obtained from equation (25).

In addition, the following method may be used to reduce the operation amount required to search the code book:

$$G_j = \left\{ \sum_i \Psi(i) c_{1j}(1) \right\}^2 \tag{29}$$

for $$\Psi(i) = \sum_n e_w(n) h_w(n - i) \tag{30}$$

$$C_j = \mu(0)^* v_j(0) + 2 \sum_i \mu(i) v_j(i) \tag{31}$$

where $\mu(i)$ and $v_j(i)$ are respectively auto-correlation functions delayed by an order i from the weighted impulse response $h_w(n)$ and from the code word $c_{1j}(n)$.

An index representing the code word obtained by the above method, and the gain $\gamma_1$ are respectively output to the multiplexer 260 and a quantizer 240. In addition, the selected code word $c_j(n)$ is output to a multiplier 241.

The quantizer 240 quantizes the gain $\gamma_1$ with a predetermined number of bits to obtain a code, and outputs the code to the multiplexer 260. At the same time, the quantizer 240 outputs a quantized decoded value $\gamma'_1$ to the multiplier 241.

The multiplier 241 multiplies the code word $c_{1j}(n)$ by the gain $\gamma'_1$ according to the following equation to obtain a sound source signal q(n), and outputs it to an adder 290 and a synthetic filter 250:

$$q(n) = \gamma'_1 c_{1j}(n) \tag{32}$$

The synthetic filter 250 receives the output q(n) from the multiplier 241, obtains a weighted synthesized signal $y_w(n)$ according to the following equation, and outputs it:

$$y_w(n) = q(n)^* h_w(n) \tag{33}$$

A subtractor 255 subtracts $y_w(n)$ from $e_w(n)$ and outputs the result to a second code book search circuit 270.

The second code book search circuit 270 selects an optimal code word from a second code book 275 and calculates an optimal gain $\gamma_2$. The second code book search circuit 270 may be constituted by essentially the same arrangement of the first code book search circuit shown in FIG. 2. In addition, the same code word search method used for the first code book ca be used for the second code book. As the second code book, a code book constituted by a random number series is used to compensate for the training data dependency while keeping the high efficiency of the code book formed by a learning procedure, which is described earlier herein. With regard to a method of forming the code book constituted by a random number series, refer to reference 1.

In addition, in order to reduce the operation amount for a search operation of the second code book, a random number code book having an overlap arrangement may be used as the second code book. With regard to methods of forming an overlap type random number code book and searching the code book, refer to reference 7.

A quantizer 285 performs the same operation as that performed by the quantizer 240 so as to quantize the gain $\gamma_2$ with a predetermined number of quantization bits and to output it to the multiplexer 260. In addition, the quantizer 285 outputs a coded/decoded value $\gamma'_2$ of the gain to a multiplier 242.

The multiplier 242 performs the same operation as that performed by the multiplier 241 so as to multiply a code word $c_{2j}(n)$, selected from the second code book, by the gain $\gamma'_2$, and outputs it to the adder 290.

The adder 290 adds the output signals from the adaptive code book 210 and the multipliers 241 and 242, and outputs the addition result to a synthetic filter and the delay circuit 206.

$$v(n) = \gamma'_1 c_{1j}(n) + \gamma'_2 c_{2j}(n) + \beta'_j v(n - M) \tag{34}$$

The synthetic filter 281 receives an output v(n) from the adder 290, and obtains a one-frame (N point) synthesized speech component according to the following equation. Upon reception of a 0 series of another one-frame speech component, the filter 281 further obtains a response signal series, and outputs a response signal series corresponding to one frame to the subtractor 190.

$$x(n) = v(n) + \sum_{i=1}^{L} a'_i x(n - i) \tag{35}$$

for $$b(n) = \begin{cases} v(n) & (1 \leqq n \leqq N) \\ 0 & (N + 1 \leqq n \leqq 2N) \end{cases} \tag{36}$$

The multiplexer 260 outputs a combination of output code series from the LSP quantizer 140, the first code book search circuit 230, the second code book search circuit 270, the quantizer 240, and the quantizer 285.

Figure 3:
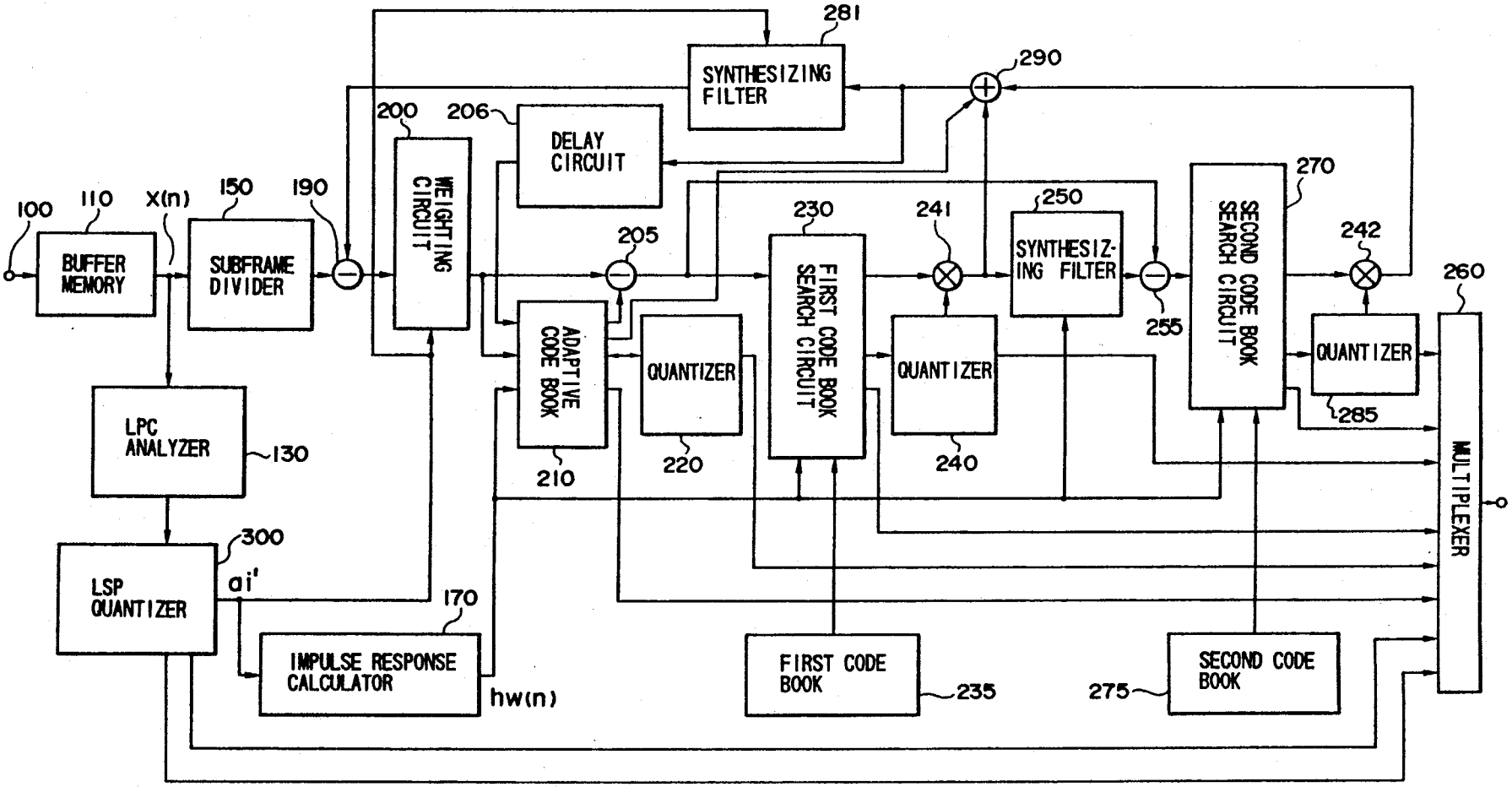
FIG. 3 is a block diagram showing a speech coder according to another embodiment of the present invention.

FIG. 3 shows another embodiment of the present invention. Since the same reference numerals in FIG. 3 denote the same parts as in FIG. 1, and they perform the same operations, a description thereof will be omitted.

Since an LSP quantizer 300 is a characteristic feature of this embodiment, the following description will be mainly associated with the LSP quantizer 300.

Figure 4:
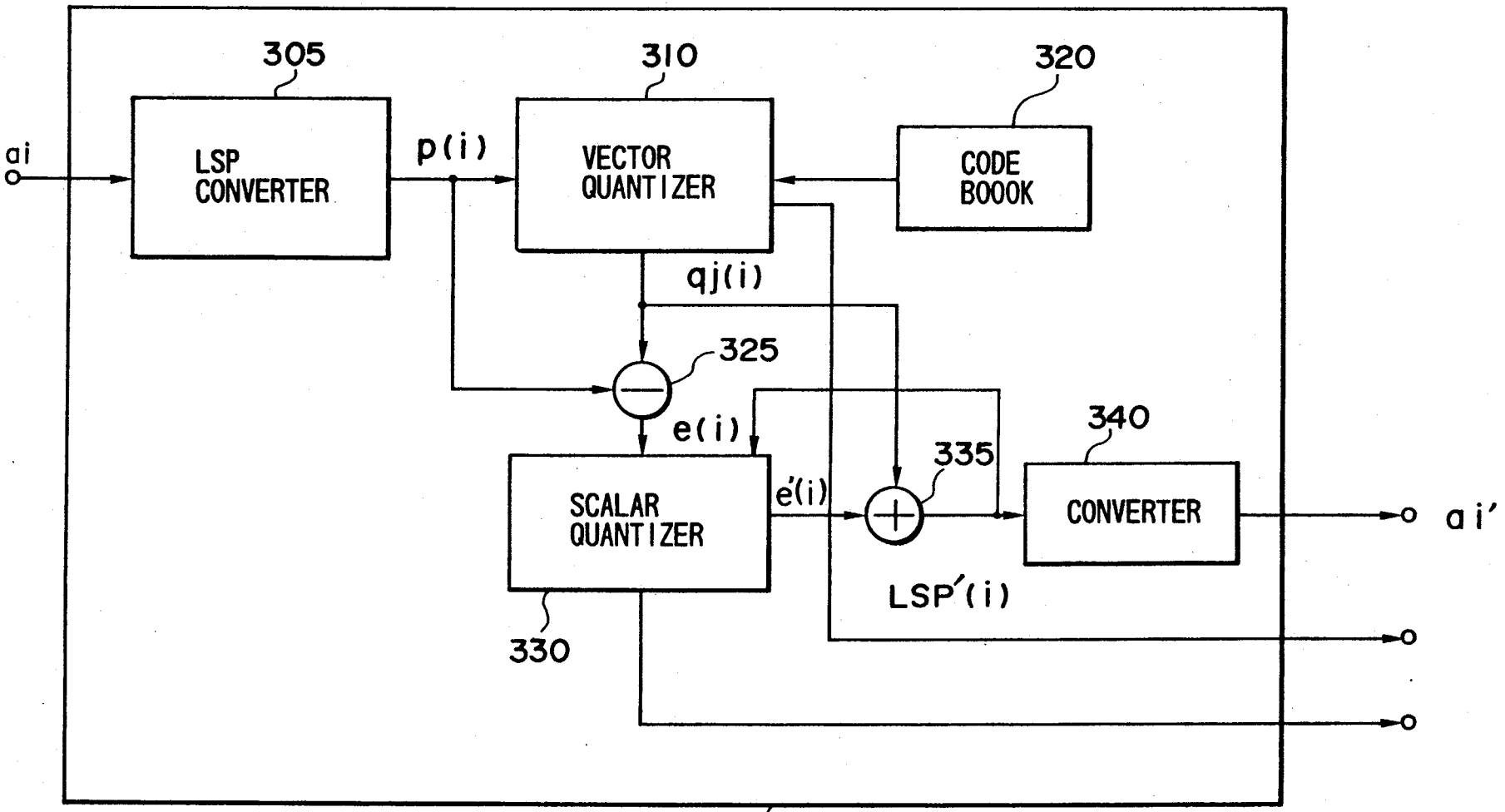
FIG. 4 is a block diagram showing an arrangement of an LSP quantizer of the speech coder in FIG. 3.

FIG. 4 shows an arrangement of the LSP quantizer 300. Referring to FIG. 4, an LSP converter 305 converts an input LPC coefficient $a_i$ into an LSP coefficient. For a detailed description of a method of converting an LPC coefficient into an LSP coefficient, refer to, e.g., reference 6.

A vector quantizer 310 vector-quantizes the input LSP coefficient according to equation (6). In this case, a code book 320 is formed beforehand by a learning procedure using a large amount of LSP data. For a detailed description of a learning method, refer to, e.g., reference 4. The vector quantizer 310 outputs an index representing a selected code word to a multiplexer 260, and outputs a vector-quantized LSP coefficient $q_f(i)$ to a subtractor 325 and an adder 335.

The subtractor 325 subtracts the vector-quantized LSP coefficient $q_f(i)$, as the output from the vector quantizer 310, from the input LSP coefficient p(i), and outputs a difference signal e(i) to a scalar quantizer 330.

The scalar quantizer 330 obtains the statistical distribution of a large number of difference signals in advance so as to determine a quantization range, as previously described with reference to the function of the present invention. For example, a 1% frequency point and a 99% frequency point in the statistic distribution of difference signals are measured for each order of a difference signal, and the measured frequency points are set as the lower and upper limits of quantization. A difference signal is then uniformly quantized between the lower and upper limits by a uniform quantizer. Alternatively, the variance of e(i) is checked for each order so that quantization is performed by a scalar quantizer having a predetermined statistic distribution, e.g., a Gaussian distribution.

In addition, the range of scalar quantization is limited in the following manner to prevent a synthetic filter from becoming unstable when the sequence of LSP coefficients is reversed upon scalar quantization.

If $q_f(i-1)+\{99\%\text{ point of } e(i-1)\}<LSP'(i)$, scalar quantization is performed by setting the 99% point and the 1% point of e(i−1) to be the maximum and minimum values of a quantization range.

If $q_f(i-1)+\{99\%\text{ point of } e(i-1)\}\geqq LSP'(i)$, scalar quantization is performed by setting $\{LSP'(i)-q_f(i)\}$ to be the maximum value of a quantization range.

The scalar quantizer 330 outputs a code obtained by quantizing a difference signal, and outputs a quantized/decoded value e,(i) to the adder 335.

The adder 335 adds the vector-quantized coefficient $q_f(i)$ and the scalar-quantized/decoded value e'(i) according to the following equation, thus obtaining and outputting a quantized/decoded LSP value LSP'(i):

$$LSP'(i)=q_f(i)+e'(i)\ (i=1\sim L) \tag{37}$$

A converter 340 converts the quantized/decoded LSP into a linear prediction coefficient $a'_i$ by using a known method, and outputs it.

In the above embodiments, the gain of the adaptive code book and the gains of the first and second code books are not simultaneously optimized. In the following embodiment, however, simultaneous optimization is performed for the gains of adaptive code book and of first and second code books to further improve the characteristics. As described with reference to the function of the present invention, if this simultaneous optimization is applied to obtain code words of the first and second code books, an improvement in characteristics can be realized.

For example, when a code word $c_{1f}(n)$ and a gain $\gamma_1$ are to be searched out after a delay and a gain $\beta$ of the adaptive code book are obtained, $\beta$ and $\gamma_1$ are simultaneously optimized in units of code words by solving the following equation so as to minimize it:

$$E=\sum_n [\{x(n)-\beta v(n-M)*h(n)-\gamma_1 c_{1f}(n)*h(n)\}*w(n)]^2 \tag{38}$$

Then, $$\begin{bmatrix} R_{11} R_{12} \\ R_{12} R_{22} \end{bmatrix} \begin{bmatrix} \beta \\ \gamma_1 \end{bmatrix} = \begin{bmatrix} P_1 \\ P_2 \end{bmatrix} \tag{39}$$

In this case, $$R_{11}=\sum_n \{v(n-M)*h_w(n)\}^2 \tag{40a}$$

$$R_{12}=\sum_n \{v(n-M)*h_w(n)\}\{c_{1f}(n)*h_w(n)\} \tag{40b}$$

$$R_{22}=\sum_n \{c_{1f}(n)*h_w(n)\}^2 \tag{40c}$$

$$P_1=\sum_n x_w(n)\{v(n-M)*h_w(n)\} \tag{40d}$$

$$P_2=\sum_n x_w(n)\{c_{1f}(n)*h_w(n)\} \tag{40e}$$

When the second code word is to be determined, the gains of the adaptive code book and of the first and second code books are simultaneously optimized to minimize the following equation:

$$E=\sum_n [\{x(n)-\beta v(n-M)*h(n)-\gamma_1 c_{1f}(n)*h(n)-\gamma_2 c_{2f}(n)*h(n)\}*w(n)]^2 \tag{41}$$

In order to reduce the operation amount, gain optimization may be performed by using equation (39) when the first code book is searched for a code word, so that no optimization need be performed in a search operation with respect to the second code book.

The operation amount can be further reduced in the following manner. When a code book is searched for a code word, no gain optimization is performed. When a code word is selected from the first code book, the gains of the adaptive code book and the first code book are simultaneously optimized. When a code word is selected from the second code book, the gains of the adaptive code book and of the first and second code books are simultaneously optimized.

In order to further reduce the operation amount, the three types of gains, i.e., the gain $\beta$ of the adaptive code book and the gains $\gamma_1$ and $\gamma_2$ of the first and second code books, may be simultaneously optimized after code words are selected from the first and second code books.

A known method other than the method in each embodiment described above may be used to search the first code book. For example, the method described in reference 1 may be used. In another method, an orthogonal conversion value $c_1(k)$ of each code word $c_{1f}(n)$ of a code book is obtained and stored in advance, and orthogonal conversion values $H_w(k)$ of the weighted impulse responses $h_w(n)$ and orthogonal conversion values $E_w(k)$ of the difference signals $e_w(n)$ are obtained by an amount corresponding to a predetermined number of points in units of subframes, so that the following equations are respectively used in place of equations (26) and (27):

$$G_j(k) = E_w(k)\{C_{1j}(k)H_w(k)\} \quad (0 \leqq k \leqq N-1) \tag{42}$$

$$C_j(k) = \{C_{1j}(k)H_w(k)\}^2 \quad (0 \leqq k \leqq N-1) \tag{43}$$

Equations (42) and (43) are then subjected to reverse orthogonal conversion to calculate a cross-correlation function $G_j$ and an auto-correlation function $C_j$, and a search for a code word and calculations of gains are performed according to equations (28) and (25). According to this method, since the convolution operations in equations (26) and (27) can be replaced with multiplication operations on the frequency axis, the operation amount can be reduced.

As a method of searching the second code book, a method other than the method in each embodiment described above, e.g., the method described above, the method in reference 7, or one of other known methods may be used.

As a method of forming the second code book, a method other than the method in each embodiment described above may be used. For example, an enormous amount of random number series are prepared as a code book, and a search for random number series is performed with respect to training data by using the random number series. Subsequently, code words are sequentially registered in the order of decreasing frequencies at which they are selected or in the order of increasing error power with respect to the training data, thus forming the second code book. Note that this forming method can be used to form the first code book.

As another method, the second code book can be constructed by learning the code book in advance, using the signal which is output from the subtractor 255.

In each embodiment described above, the adaptive code book of the first order is used. However, an adaptive code book of the second or higher order may be used. Alternatively, fractional delays may be set instead of integral delays while the first order of the code book is kept unchanged. For a detailed description of these arrangements, refer to, e.g., Marques et al., "Pitch Prediction with Fractional Delays in CELP Coding", *EUROSPEECH*, pp. 509–513, 1989 (reference 8). With the above described arrangements, an improvement in characteristics can be realized. However, the amount of information required for the transmission of gains or delays is slightly increased.

Furthermore, in each embodiment described above, K parameters and LSP parameters as spectrum parameters are coded, and LPC analysis is used as the method of analyzing these parameters. However, other known parameters, e.g., an LPC cepstrum, a cepstrum, an improved cepstrum, a general cepstrum, and a melcepstrum may be used. An optimal analysis method for each parameter may be used.

LPC coefficients obtained in a frame may be interpolated in units of subframes so that an adaptive code book and first and second code books are searched by using the interpolated coefficients. With this arrangement, the speech quality can be further improved.

In order to reduce the operation amount, calculations of influential signals may be omitted on the transmission side. With this omission, the synthetic filter 281 and the subtractor 190 can be omitted, thus allowing a reduction in operation amount. In this case, however, the speech quality is slightly degraded.

Furthermore, in order to reduce the operation amount, the weighting circuit 200 may be arranged in front of the subframe divider 150 or in front of the subtractor 190, and the synthetic filter 281 may be designed to calculate a weighted synthesized signal according to the following equation:

$$x_w(n) = V(n) + \sum_{i=1}^{L} a_i\gamma^i x_w(n-i) \quad (0 < \gamma < 1) \tag{44}$$

where $\gamma$ is the weighting coefficient for determining the degree of perceptual weighting.

Moreover, an adaptive post filter which is operated in response to at least a pitch or a spectrum envelope may be additionally arranged on the receiver side so as to perceptually improve speech quality by shaping quantization noise. With regard to an arrangement of an adaptive post filter, refer to, e.g., Kroon et al., "A Class of Analysis-by-synthesis Predictive Coders for High Quality Speech Coding at Rates between 4.8 and 16 kb/s", *IEEE JSAC*, vol. 6, 2, 353–363, 1988 (reference 9).

As is well known in the field of digital signal processing, since an auto-correlation function and a cross-correlation function respectively correspond to a power spectrum and a cross power spectrum on the frequency axis, they can be calculated from these spectra. With regard to a method of calculating these functions, refer to Oppenheim et al., "Digital Signal Processing", Prentice-Hall, 1975 (reference 10).

Figure 5:
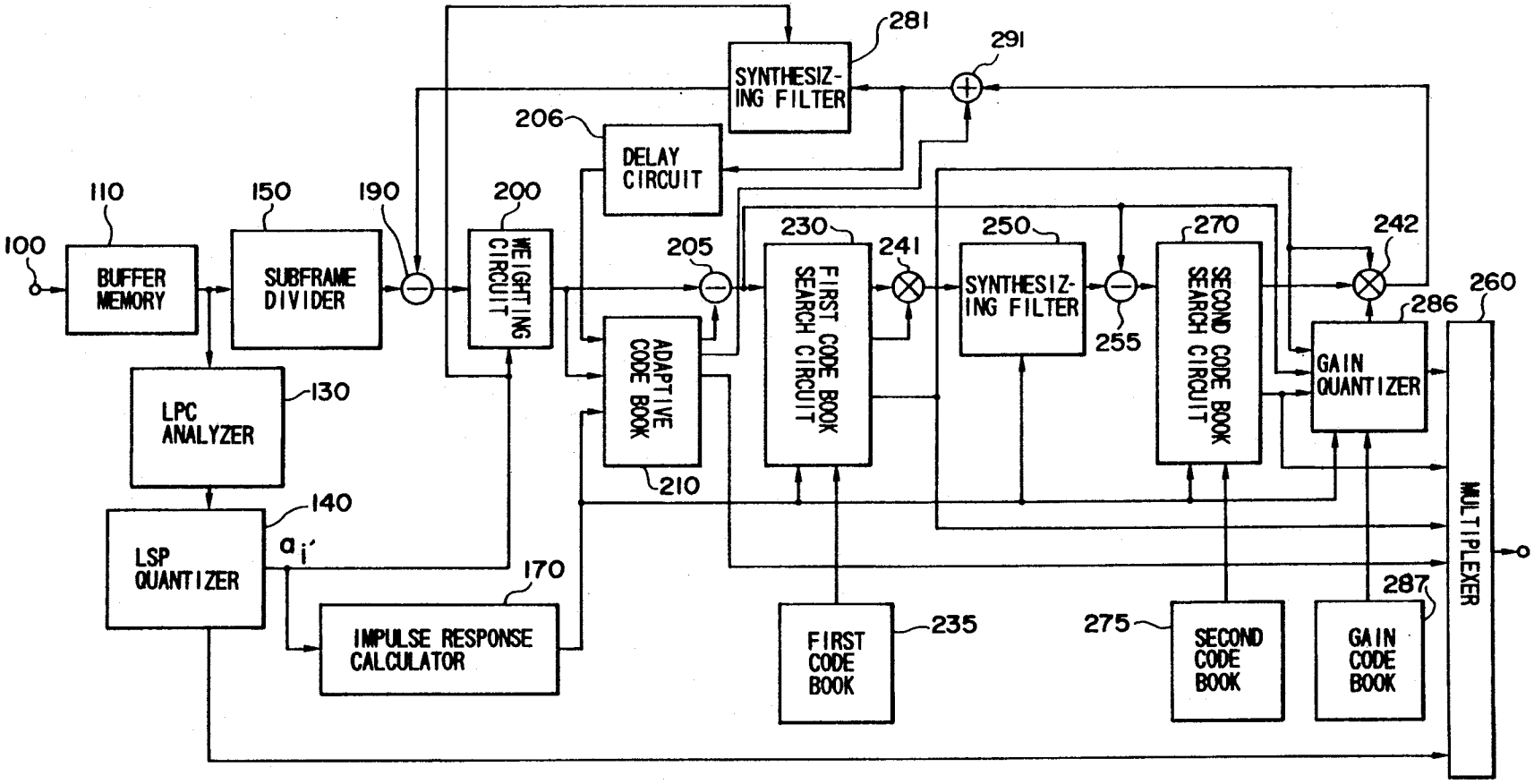
FIG. 5 is a block diagram showing a speech coder according to still another embodiment of the present invention.

FIG. 5 shows a speech coder according to still another embodiment of the present invention. Since the same reference numerals in FIG. 5 denote the same parts as in FIG. 1, and they perform the same operations, a description thereof will be omitted.

An adaptive code book 210 calculates a prediction signal $x_w(n)$ by using an obtained gain $\beta$ according to the following equation and outputs it to a subtractor 205. In addition, the adaptive code book 210 outputs a delay M to a multiplexer 260.

$$x_w(n) = \beta \cdot v(n-M) * h_w(n) \tag{45}$$

where $v(n-M)$ is the input signal to a synthetic filter 281, and $h_w(n)$ is the weighted impulse response obtained by an impulse response calculator 170.

A multiplier 241 multiplies a code word $c_j(n)$ by a gain $\gamma_1$ according to the following equation to obtain a sound source signal q(n), and outputs the signal to a synthetic filter 250.

$$q(n) = \gamma_1 c_j(n) \tag{46}$$

Figure 6:
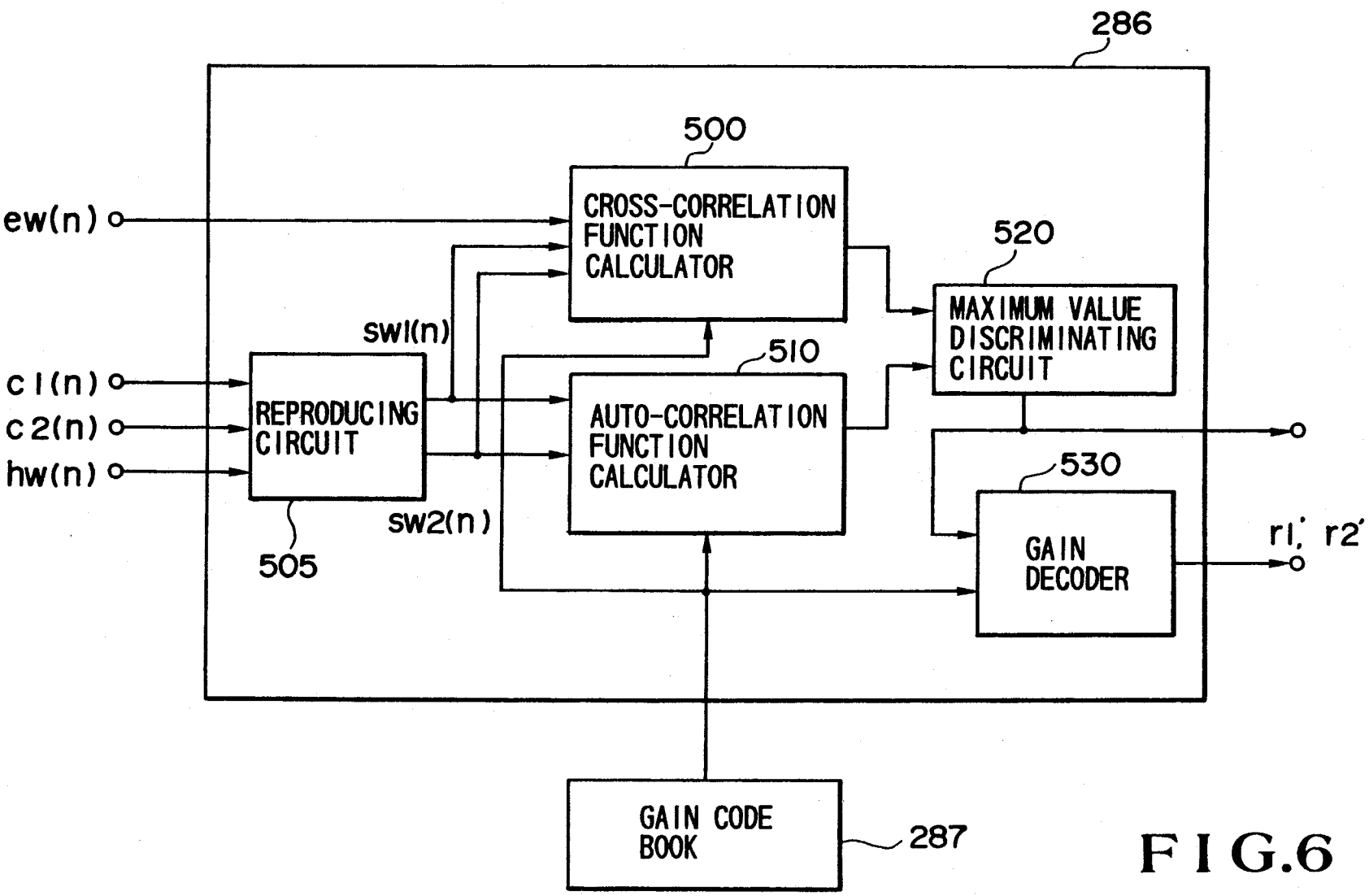
FIG. 6 is a block diagram showing an arrangement of a gain quantizer according to the present invention.

A gain quantizer 286 vector-quantizes gains $\gamma_1$ and $\gamma_2$ method described above using a gain code book formed by using equation (15) or (16). In vector quantization, an optimal word code is selected by using equation (11). FIG. 6 shows an arrangement of the gain quantizer 286. Referring to FIG. 6, a reproducing circuit 505 receives $c_1(n)$, $c_2(n)$, and $h_w(n)$ to obtain $s_{w1}(n)$ and $s_{w2}(n)$ according to equations (12) and (13).

A cross-correlation calculator 500 and an auto-correlation calculator 510 receive $e_w(n)$, $s_{w1}(n)$, $s_{w2}(n)$, and a code word output from the gain code book 287, and calculate the second and subsequent terms of equation (11). A maximum value discriminating circuit 520 discriminates the maximum value in the second and subsequent terms of equation (11) and outputs an index representing a corresponding code word from the gain code book. A gain decoder 530 decodes the gain by using the index and outputs the result. The gain decoder 530 then outputs the index of the code book to the multiplexer 260. In addition, the gain decoder 530 outputs decoded gain values $\gamma'_1$ and $\gamma'_2$ to a multiplier 242.

The multiplier 242 multiplies the code words $c_{1j}(n)$ and $c_{2i}(n)$ respectively selected from the first and second code books by the quantized/decoded gains $\gamma'_1$ and $\gamma'_2$, and outputs the multiplication result to the adder 291. The adder 291 adds the output signals from the adaptive code book 210 and the multiplier 242, and outputs the addition result to the synthetic filter 281.

The multiplexer 260 outputs a combination of code series output from an LSP quantizer 140, an adaptive code book 210, a first code book search circuit 230, a second code book search circuit 270, and the gain quantizer 286.

Figure 7:
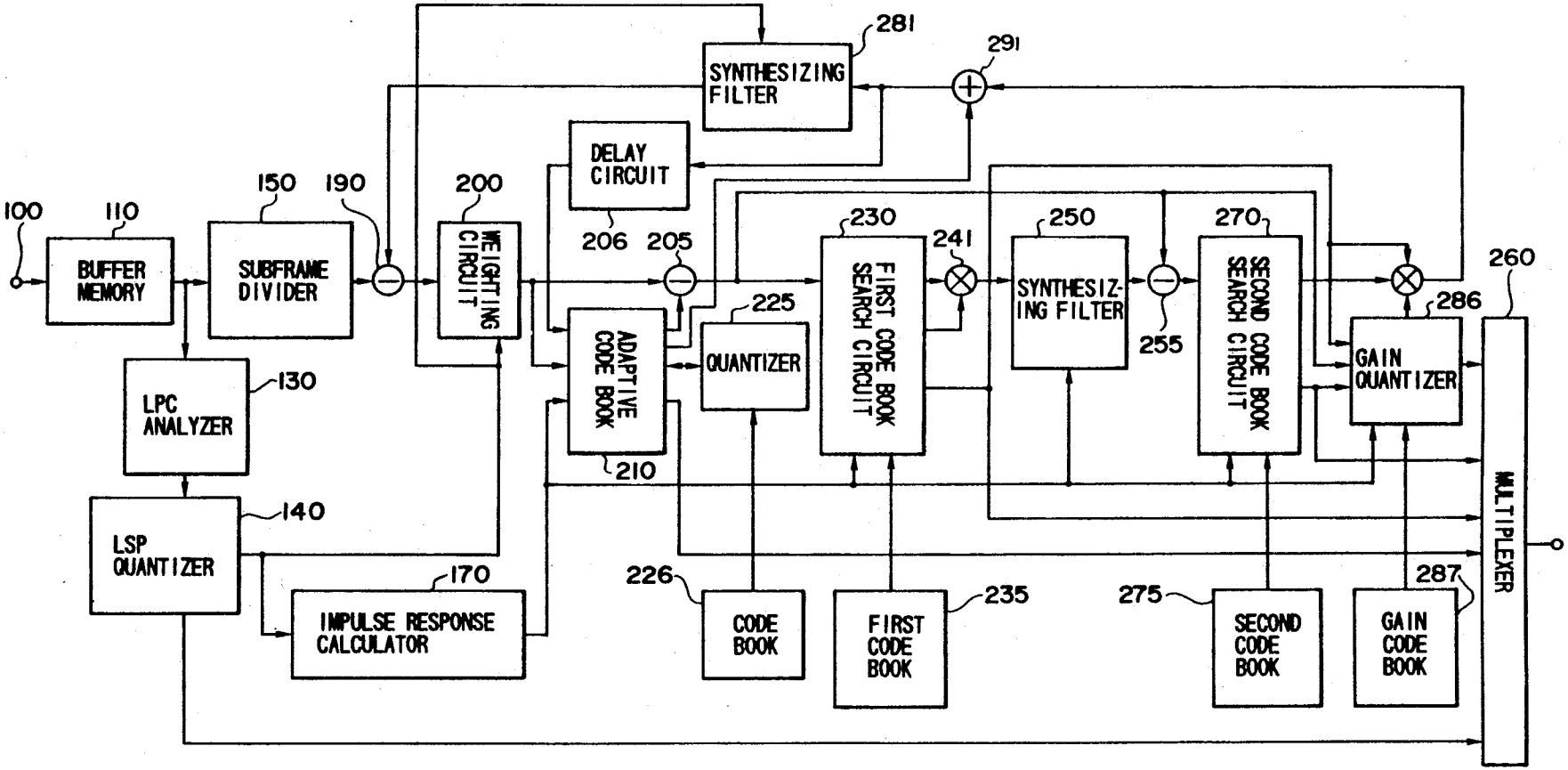
FIG. 7 is a block diagram showing a speech coder according to still another embodiment of the present invention.

FIG. 7 shows still another embodiment of the present invention. Since the same reference numerals in FIG. 7 denote the same parts as in FIG. 1, and they perform the same operations, a description thereof will be omitted.

A quantizer 225 vector-quantizes the gain of an adaptive code book by using a code book 226 formed by a learning procedure according to equation (20). The quantizer 225 then outputs an index representing an optimal code word to a multiplexer 260. In addition, the quantizer 225 quantizes/decodes the gain and outputs the result.

The gains of the adaptive code book and of the first and second code books may be vector-quantized together instead of performing the quantization described with reference to the above embodiment.

Furthermore, in order to reduce the operation amount, optimal code words may be selected by using equations (21) and (14) in vector quantization of the gain of the adaptive code book and the gains $\gamma_1$ and $\gamma_2$.

In addition, vector quantization of the gains of the adaptive code book and of the first and second code books may be performed such that a third code book is formed beforehand by a learning procedure on the basis of the absolute values of gains, and vector quantization is performed by quantizing the absolute values of gains while signs are separately transmitted.

As has been described above, according to the present invention, a code book representing sound source signals is divided into two code books. The first code book is formed beforehand by a learning procedure using training signals based on a large number of difference signals. The second code book has predetermined statistical characteristics. By using the first and second code books, excellent characteristics can be obtained with a smaller operation amount than that of the conventional system. In addition, a further improvement in characteristics can be realized by optimizing the gains of the code books. Furthermore, by effectively quantizing spectrum parameters by using a combination of the vector quantizer and the scalar quantizer, the transmission information amount can be set to be smaller than that in the conventional system. Moreover, by vector-quantizing the gain of the code book and the gain of the adaptive code book based on pitch prediction by means of the gain code book formed beforehand by a learning procedure based on a large amount of training signals, the system of the present invention can provide better characteristics with a smaller operation amount than the conventional system.

In comparison with the conventional system, the system of the present invention has a great advantage that high-quality coded/reproduced speech can be obtained at a bit rate of 8 to 4.8 kb/s.

What is claimed is:

1. A speech coder comprising:

means for dividing a discrete input speech signal into signal components in units of frames each frame having a predetermined time length, and for generating a spectrum parameter representing a spectrum envelope of said discrete input speech signal;

means for generating a subframe signal by dividing the frame into subframes each subframe having a predetermined time length, and for calculating a pitch parameter using a correlation between said discrete input speech signal and synthetic speech calculated from an excitation signal generated from a previous discrete input speech signal;

a first code book for storing code vectors formed by off-line training based on a speech signal data base;

a second code book for storing code vectors having predetermined statistical characteristics; and means for generating an excitation signal of the discrete input speech signal by a linear combination of a code vector selected from said first code book in accordance with each obtained subframe signal and a code vector selected from said second code book, and outputting an index of said code vector selected from said first code book and an index of said code vector selected from said second code book together with said spectrum parameter and said pitch parameter.

2. The speech coder according to claim 1, wherein said second code book stores code vectors formed by off-line training.

3. The speech coder according to claim 1, further comprising a third code book for storing code vectors formed in advance by off-line training based on a spectrum parameter data base, means for selecting one optimal type of code vector from said third code book, and for generating an error signal between the spectrum parameter and the selected code vector from the third code book, and means for quantizing the error signal on the basis of a statistical distribution range obtained in advance by a statistically measured error signal data base, thereby representing the spectrum parameter.

4. The speech coder according to claim 1, further comprising means for generating an excitation signal of the discrete input speech signal by a linear combination of a code vector selected from said first code book and a code vector selected from said second code book, the code vectors being selected while a gain of said pitch parameter and a gain of at least one code vector from said first and second code books are adjusted.

5. The speech coder according to claim 1, further comprising means for selecting the pitch parameter and code vectors from said first and second code books, subsequently adjusting gains of the selected code vectors, and generating an excitation signal of the discrete input speech signal by a gain weighted linear combination of the selected signals.

6. A speech coder comprising:

means for dividing a discrete input speech signal into signal components in units of frames each frame having a predetermined time length, and for generating a spectrum parameter representing a spectrum envelope of said discrete input speech signal;

means for dividing the frame into subframes each subframe having a predetermined time length, and for generating a pitch parameter so as to maximize correlation between a subframe signal and synthetic speech calculated from an excitation signal generated from a previous discrete input speech signal;

a first code book for storing code vectors formed by off-line training based on a speech signal data base;

a second code book for storing code vectors having predetermined statistical characteristics;

means for generating an excitation signal of the discrete input speech signal by a linear combination of code vectors respectively selected from said first and second code books; and means for quantizing gains of at least one of the pitch parameter and gains of said first and second code books by using a gain code book formed in advance by off-line training, and outputting a quantized gain.

7. The speech coder according to claim 6, wherein said second code book stores code vectors formed by off-line training using a speech signal.

8. A speech coder comprising:

means for dividing a discrete input speech signal into signal components in units of frames each frame having a predetermined time length, and for generating a spectrum parameter representing a spectrum envelope of said discrete input speech signal;

means for dividing the frame into subframes each subframe having a predetermined time length, and for generating a delay amount of a pitch parameter so as to maximize a correlation between a subframe signal and synthetic speech calculated from an excitation signal generated by a previous discrete input signal;

means for quantizing a gain of the pitch parameter by using a fourth code book formed in advance;

a first code book for storing code vectors formed by off-line training based on the discrete input speech signal;

a second code book for storing code vectors having predetermined statistical characteristics; and means for generating an excitation signal of the discrete input speech signal by a linear combination of code vectors respectively selected from said first and second code books, and outputting an index of said code vectors.

9. The speech coder according to claim 8, wherein said second code book stores a signal formed by off-line training.

* * * * *

UNITED STATES PATENT AND TRADEMARK OFFICE

CERTIFICATE OF CORRECTION

PATENT NO. : 5,208,862

DATED : May 4, 1993

INVENTOR(S) : Kazunori OZAWA

It is certified that error appears in the above-identified patent and that said Letters Patent is hereby corrected as shown below:

Col. 5, line 55, delete "$\gamma'^2_1\Sigma s^2_{w1}(n) - \gamma'^2_2\Sigma s^2_{w2}(n) - 2\gamma'_1\gamma'_2\Sigma s_{w1}(n)s_{w2}(n)]$" and insert --$\gamma'^2_1\Sigma s_{w1}^2(n) - \gamma'^2_2\Sigma s_{w2}^2(n) - 2\gamma'_1\gamma'_2\Sigma s_{w1}(n)s_{w2}(n)]$--.

Col. 8, line 6, delete "$X_w$" and insert --$\hat{X}_w$--;

Col. 8, line 12, delete "$X_w$" and insert --$\hat{X}_w$--;

Col. 8, line 25, delete "$X_w$" and insert --$\hat{X}_w$--;

Col. 8, line 32, delete "$-X_w(n)$" and insert -- $-\hat{X}_w(n)$--.

Col. 9, line 66, delete "ca" and insert --can--.

UNITED STATES PATENT AND TRADEMARK OFFICE

CERTIFICATE OF CORRECTION

PATENT NO. : 5,208,862

DATED : May 4, 1993

INVENTOR(S) : Kazunori OZAWA

It is certified that error appears in the above-identified patent and that said Letters Patent is hereby corrected as shown below:

Col. 10, line 41, delete both occurrences of "x" and insert --$\tilde{x}$--.

Col. 14, line 6, delete both occurrences of "x" and insert --$\tilde{x}$--;

Col. 14, line 35, delete "$X_w$" and insert --$\hat{X}_w$--;

Col. 14, line 40, delete "$X_w$" and insert --$\hat{X}_w$--.

Signed and Sealed this

Nineteenth Day of July, 1994

*Attest:*

*Attesting Officer*

Bruce Lehman

BRUCE LEHMAN

*Commissioner of Patents and Trademarks*